US012152775B2

(12) United States Patent
Luo

(10) Patent No.: US 12,152,775 B2
(45) Date of Patent: Nov. 26, 2024

(54) LIGHTER WITH REPLACEABLE FLINT MEMBER

(71) Applicant: Arrow Lighter, Inc., City of Industry, CA (US)

(72) Inventor: Zhuowen Luo, San Marino, CA (US)

( * ) Notice: Subject to any disclaimer, the term of this patent is extended or adjusted under 35 U.S.C. 154(b) by 469 days.

(21) Appl. No.: 17/519,549

(22) Filed: Nov. 4, 2021

(65) Prior Publication Data

US 2023/0135739 A1 May 4, 2023

(51) Int. Cl.

| | |
|---|---|
| ***F23Q 2/48*** | (2006.01) |
| ***F23Q 2/16*** | (2006.01) |
| ***F23Q 2/38*** | (2006.01) |
| ***F23Q 2/46*** | (2006.01) |

(52) U.S. Cl.

CPC ..... *F23Q 2/48* (2013.01); *F23Q 2/163* (2013.01); *F23Q 2/38* (2013.01); *F23Q 2/46* (2013.01)

(58) Field of Classification Search

CPC ... F23Q 2/48; F23Q 2/163; F23Q 2/38; F23Q 2/46

USPC ..... 431/273–277, 133, 136, 138–141

See application file for complete search history.

(56) References Cited

U.S. PATENT DOCUMENTS

| | | | | |
|---|---|---|---|---|
| 3,176,481 A * | 4/1965 | Burchett | F23Q 2/48 | 431/276 |
| 4,929,174 A * | 5/1990 | Wang | F23Q 2/163 | 431/344 |
| 5,020,990 A * | 6/1991 | Chen | F23Q 2/46 | 431/274 |

* cited by examiner

*Primary Examiner* — Vivek K Shirsat

(74) *Attorney, Agent, or Firm* — Tsz Lung Yeung

(57) ABSTRACT

A lighter includes a fuel casing, a gas-releasing nozzle, a supporting frame provided on the fuel casing, a fuel mounting frame, a spark wheel, a flint member and an actuator. The flint mounting frame has an upper operative frame detachably mounted on the supporting frame, and a lower mounting frame extended into the fuel casing. The spark wheel is rotatably supported on the upper operative frame of the flint mounting frame. The flint member is detachably mounted in the lower mounting frame of the flint mounting frame and extended toward the upper operative frame to communicate with the spark wheel. When the flint mounting frame is detached from the supporting frame and the fuel casing, the flint member is capable of being detached from the lower mounting frame for replacement of a new flint member.

7 Claims, 8 Drawing Sheets

LIGHTER WITH REPLACEABLE FLINT MEMBER

BACKGROUND

Field of Invention

The present invention relates to a lighter, and more particularly to a lighter comprising a flint mounting frame which can be detached from a fuel casing and a supporting frame for facilitating replacement of a flint member.

Description of Related Arts

A conventional lighter usually comprises a fuel casing having a receiving cavity and a gas-releasing nozzle, an upper supporting frame mounted on the fuel casing, a flint member provided in the upper supporting frame at a position near the gas-releasing nozzle, a spark wheel rotatably supported in the upper supporting frame, and an actuator operatively provided on the fuel casing and connected to the gas-releasing nozzle. When in use, a user may simultaneously depress the actuator and rotate the spark wheel. When the actuator is depressed, the gas-releasing nozzle is lifted up so as to release gaseous fuel. At the same time, the spark wheel is arranged to hit the flint member and generate a spark so as to ignite the gaseous fuel coming out from the gas-releasing nozzle. Continuous stream of fire will then be generated by continuous supply of gaseous fuel.

A major disadvantage of conventional lighters such as the one described above is that the fire generated by the lighter is created by hitting the spark wheel against the flint member. When the lighter is used for a certain period time, the flint member will suffer wear and tear and needs replacement. The problem, however, is that it is very difficult, if not infeasible, for a user to replace the flint member. Some models of lighters simply don't allow a user to replace the flint member. As a result, instead of replacing the flint members, most people will get a new lighter and this causes a waste of resources and money.

As a result, there is a need to develop a lighter which allows a user to replace a flint member with ease and convenience.

SUMMARY OF THE PRESENT INVENTION

Certain variations of present invention provide a lighter comprising a flint mounting frame which can be detached from a fuel casing and a supporting frame for facilitating easy replacement of a flint member.

In one aspect of embodiments of the present disclosure, it provides a lighter, comprising:

a fuel casing having a fuel storage cavity, and an accommodating slot formed in the fuel storage cavity;

a gas-releasing nozzle movably provided on the fuel casing;

a supporting frame provided on the fuel casing; and a flint mounting frame having an upper operative frame detachably mounted on the supporting frame, and a lower mounting frame detachably attached on the upper operative frame and extended in the accommodating slot;

a spark wheel rotatably supported on the upper operative frame of the flint mounting frame;

a flint member detachably mounted in the lower mounting frame of the flint mounting frame and extended toward the upper operative frame to communicate with the spark wheel, in such a manner that when the spark wheel is rotated, a spark is generated at the flint member, wherein when the flint mounting frame is detached from the supporting frame and the fuel casing, the flint member is capable of being detached from the lower mounting frame for replacement; and an actuator operatively mounted on the supporting frame and connected to the gas-releasing nozzle, in such a manner that when the actuator is depressed, the gas-releasing nozzle is lifted up for releasing fuel stored in the fuel storage cavity.

This summary presented above is provided merely to introduce certain concepts and not to identify any key or essential features of the claimed subject matter.

DETAILED DESCRIPTION OF THE PREFERRED EMBODIMENT

Figure 1:
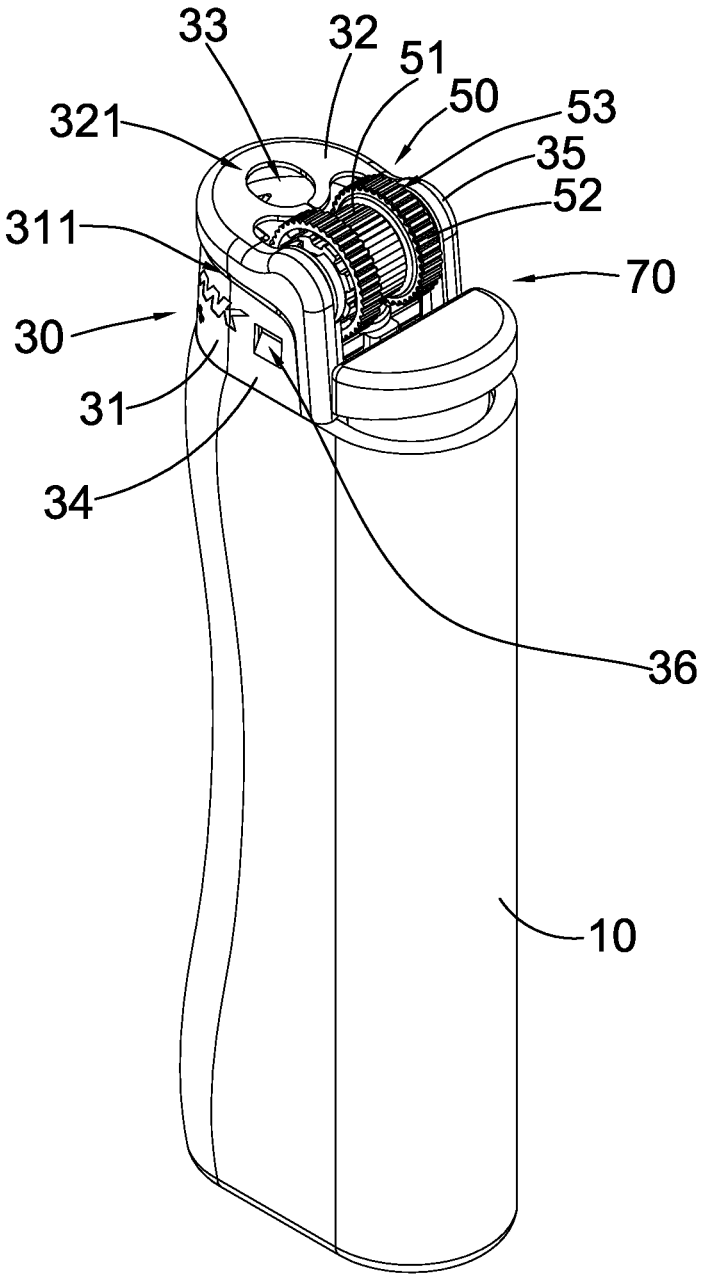
FIG. 1 is a perspective view of a lighter according to a preferred embodiment of the present invention.
Figure 2:
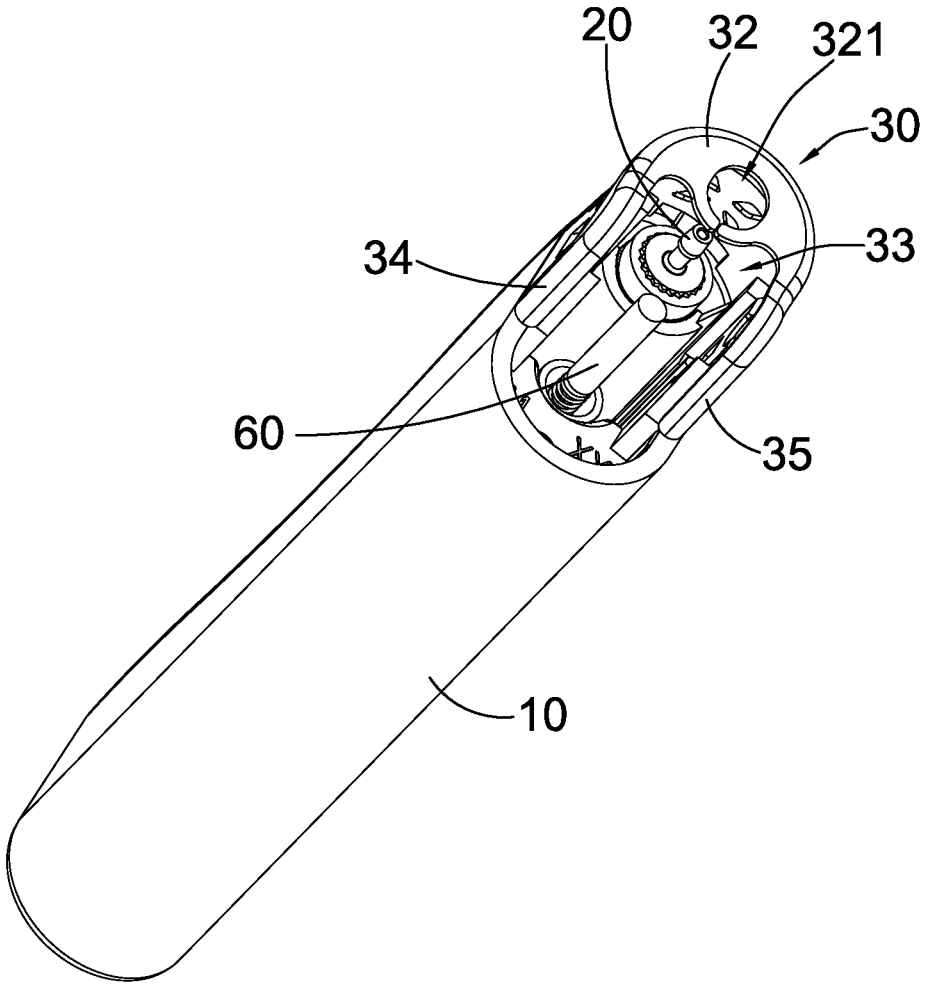
FIG. 2 is a perspective view of the lighter according to the preferred embodiment of the present invention, illustrating a gas-releasing nozzle provided on a fuel casing.

The following detailed description of the preferred embodiment is the preferred mode of carrying out the present disclosure. The description is not to be taken in any limiting sense. It is presented for the purpose of illustrating the general principles of embodiments of the present disclosure.

It should be appreciated that the terms "install", "connect", "couple", and "mount" in the following description refer to the connecting relationship in the accompanying drawings for easy understanding of embodiments of the present disclosure. For example, the connection can refer to permanent connection or detachable connection or connection through connecting pipes. Furthermore, "connected" may also mean direct connection or indirect connection, or connection through other auxiliary components, such as at least one connecting pipe 100 or at least one air conduit. Therefore, the above terms should not be an actual connection limitation of the elements of embodiments of the present disclosure.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of embodiments of the present disclosure without limiting the actual location or orientation of embodiments of the present disclosure. Therefore, the above terms should not be an actual location limitation of the elements of embodiments of the present disclosure.

It should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of embodiments of the present disclosure.

Referring to FIG. 1 to FIG. 8 and FIG. 9A to FIG. 9E of the drawings, a lighter according to a preferred embodiment of the present disclosure is illustrated. Broadly, the lighter may comprise a fuel casing 10, a gas-releasing nozzle 20 movably provided on the fuel casing 10, a supporting frame 30 provided on the fuel casing 10, a flint mounting frame 40, a spark wheel 50, a flint member 60, and an actuator 70.

The fuel casing 10 may have a fuel storage cavity 11, and an accommodating slot 12 formed in the fuel storage cavity 11. The fuel storage cavity 11 may be arranged to store a predetermined of fuel in liquid state. The gas-releasing nozzle 20 may be movably provided on the fuel casing 10 such that when the gas-releasing nozzle 20 is uplifted, the fuel in the fuel storage cavity 11 may be converted into gaseous state and may be ejected through the gas-releasing nozzle 20.

The flint mounting frame 40 may comprise an upper operative frame 41 detachably mounted on the supporting frame 30, and a lower mounting frame 42 detachably attached to the upper operative frame 41 and at least partially extended in the accommodating slot 12 of the fuel casing 10.

The spark wheel 50 may be rotatably supported on the upper operative frame 41 of the flint mounting frame 40.

The flint member 60 may be detachably mounted in the lower mounting frame 42 of the flint mounting frame 40 and extend toward the upper operative frame 41 to communicate with the spark wheel 50, in such a manner that when the spark wheel 50 is rotated, a spark is generated at the flint member 60. The flint mounting frame 40 may be detached from the supporting frame 30 and the fuel casing 10, wherein the flint member 60 may be detached from the lower mounting frame 42 of the flint mounting frame 40 for replacement by a new flint member 60.

The actuator 70 may be operatively mounted on the supporting frame 30 and connected to the gas-releasing nozzle 20, in such a manner that when the actuator 70 is depressed, the gas-releasing nozzle 20 may be lifted up for releasing the fuel stored in the fuel storage cavity 11.

According to the preferred embodiment of the present invention, the supporting frame 30 may be mounted on top of the fuel casing 10. The supporting frame 30 may comprise a side boundary wall 31, a top wall 32, and a receiving cavity 33 formed in a space surrounded by the side boundary wall 31 and the top wall 32. The side boundary wall 31 may have a curved external contour so as to match an external shape of the fuel casing 10. The top wall 32 may have a flame releasing slot 321 for allowing flame to pass through. The gas-releasing nozzle 20 may be positioned corresponding to the flame releasing slot 321 so that ignited gas released through the gas-releasing nozzle 20 may be arranged to pass through the flame releasing slot 321.

Figure 3:
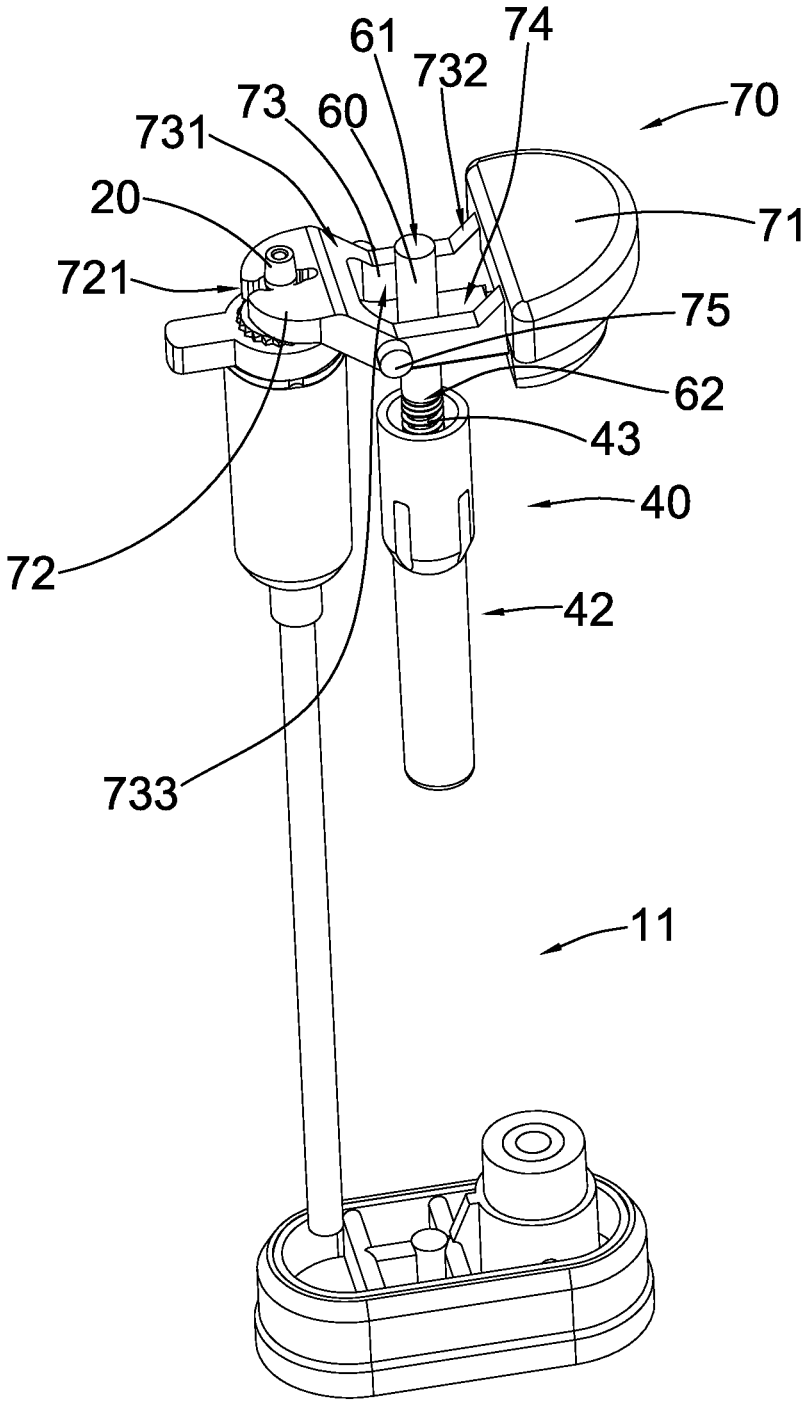
FIG. 3 is a partial perspective view of the lighter according to the preferred embodiment of the present invention, illustrating connections between an actuator, a flint mounting frame, and the gas-releasing nozzle.
Figure 4:
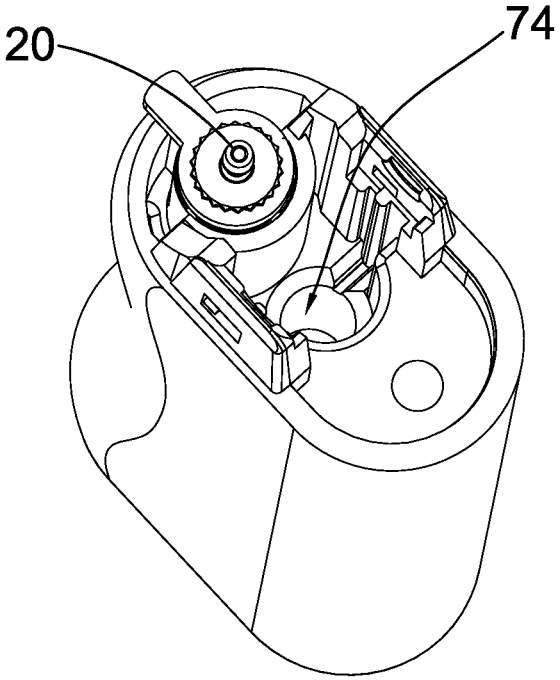
FIG. 4 is a schematic diagram of the lighter according to the preferred embodiment of the present invention, illustrating a fuel casing has an accommodating slot.

As shown in FIG. 3 of the drawings, lighter may further comprise a first securing frame 34 and a second securing frame 35 extended from the fuel casing 10 and positioned adjacent to two end portions 311 of the side boundary wall 31 of the supporting frame 30, wherein the first securing frame 34 and the second securing frame 35 may be positioned to face each other. Each of the first securing frame 34 and the second securing frame 35 may have an engaging slot 36.

The upper operative frame 41 of the flint mounting member 40 may comprise a supporting base wall 411 and two sidewalls 412 upwardly extended from the supporting base wall 411 to form a wheel cavity 413 at a space surrounded by the supporting base wall 411 and the two sidewalls 412. The spark wheel 50 may be rotatably supported in this wheel cavity 413. Moreover, the upper operative frame 41 may further comprise a plurality of engaging members 414 outwardly protruded from the two sidewalls 412 respectively, wherein the engaging members 414 may be positioned corresponding to the engaging slots 36 of the first securing frame 34 and the second securing frame 35 respectively, and may be arranged to detachably engage with the engaging slots 36 when the upper operative frame 41 is detachably accommodated in the receiving cavity 33. Thus, the engaging members 414 and the engaging slots 36 may help to secure the upper operative frame 41 on top of the fuel casing 10.

The upper operative frame 41 may further comprise an upper extension member 415 downwardly extended from the base wall 411 to detachably connect to the lower mounting frame 42. The upper extension member 415 may be configured to be a hollow structure and may have an upper cavity 4151 for accommodating the flint member 60 therein. The base wall 411 may further have a through hole 4111 formed thereon for communicating the wheel cavity 413 with the upper cavity 4141 of the upper extension member 415. As such, the flint member 60 may be accommodated in the upper extension member 415 and partially expose to the wheel cavity 413 through the through hole 4111.

Figure 6:
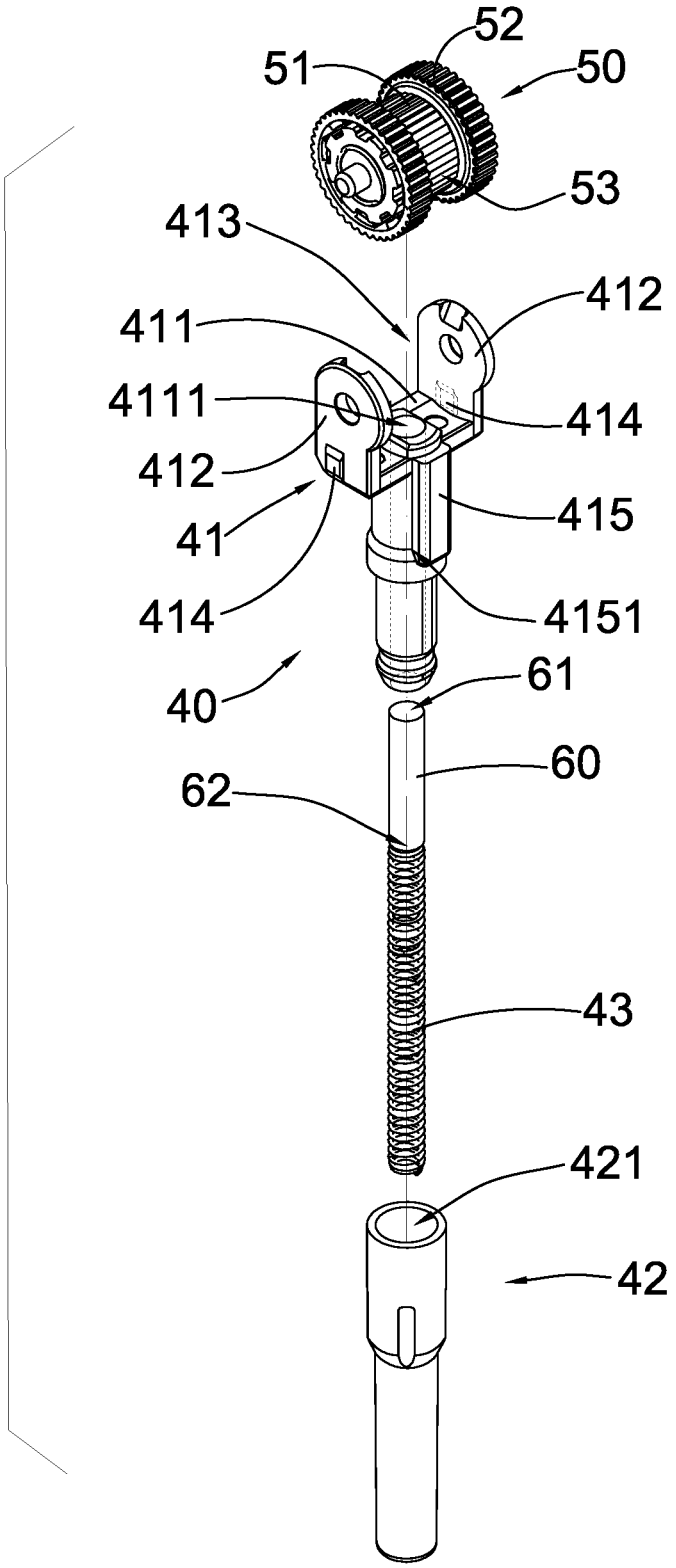
FIG. 6 is an exploded perspective view of the flint mounting frame of the lighter according to the preferred embodiment of the present invention.

On the other hand, the lower mounting frame 42 may also be configured to be a hollow structure and may have a lower cavity 421. The flint mounting member 40 may further comprise a resilient element 43 partially received in the lower cavity 421 for biasing against the flint member 60. The lower mounting frame 42 may detachably attach to the upper extension member 415 so that the lower cavity 421 may communicate with the upper cavity 4151 when the lower mounting frame 42 is detachably attached to the upper extension member 415. As shown in FIG. 6 of the drawings, the resilient element 43 may extend in the lower cavity 421 and the upper cavity 4151 for biasing against the flint member 60 received in the upper cavity 4151.

Referring to FIG. 3 of the drawings, the flint member 60 may have an elongated structure and may be partially received in the upper operative frame 41. More specifically, the flint member 60 may be movably received in at least the upper cavity 4151 (or the lower cavity 421 as well depending on the length of the flint member 60) and may extend toward the wheel cavity 413. The resilient element 43, which may be configured as a compression spring, may be received in the lower cavity 421 and may exert a biasing force against a lower end 62 of the flint member 60. Thus, the flint member 60 may be pushed by the resilient element 43 so that its upper end 61 may penetrate through the through hole 4111 and expose to the wheel cavity 413. The upper end 61 of the flint member 60 may be arranged to bias against the spark wheel 50 so that when the spark wheel 50 is driven to rotate, the spark wheel 50 may hit the flint member 60 and generate a spark in the wheel cavity 413.

The spark wheel 50 may comprise a main ignition wheel 51 and a plurality of retention wheels 52 coaxially provided at two sides of the main ignition wheel 51. A diameter of each of the retention wheels 52 may be greater than that of the main ignition wheel 51. Each of the main ignition wheel 51 and the retention wheels 52 may have a plurality of teeth 53 formed thereon, wherein the teeth 53 on the main ignition wheel 51 may be arranged to physically hit the flint member 60 when the spark wheel 50 is driven to rotate. The retention wheels 52 may be rotatably connected to the sidewalls 412 of the upper operative frame 41 so as to rotatably mount the spark wheel 50 on the flint mounting frame 40.

Figure 7:
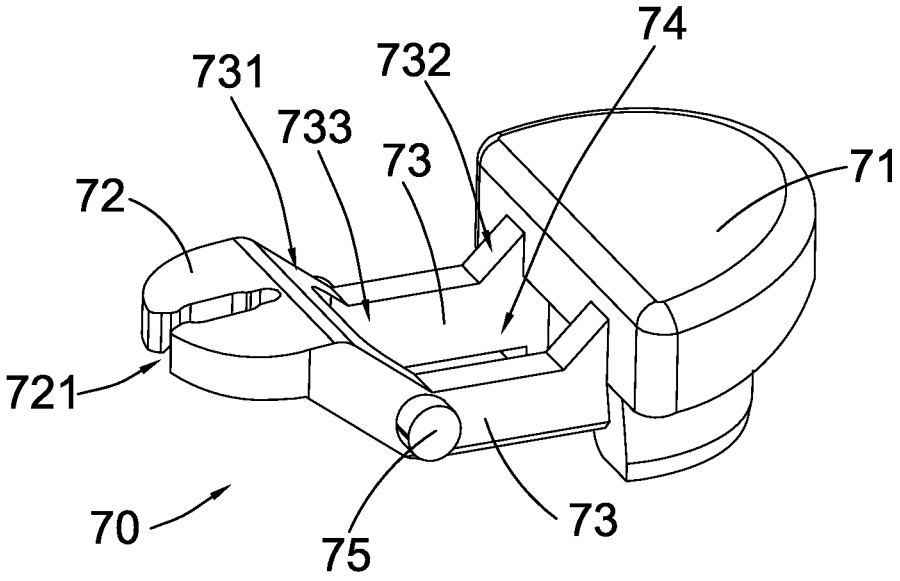
FIG. 7 is a perspective view of the actuator of the lighter according to the preferred embodiment of the present invention.

As shown in FIG. 3 and FIG. 7 of the drawings, the actuator 70 may comprise a depression member 71 movably provided on top of the fuel casing 10 adjacent to the supporting frame 30, a lifting member 72 connected to the gas-releasing nozzle 20, and at least one connecting member 73 extended between the depression member 71 and the lifting member 72. According to the preferred embodiment of the present invention, the actuator 70 may comprise a plurality of connecting members 73 spacedly extended between the depression member 71 and the lifting member 72. Thus, the actuator 70 may further have a passage slot 74 defined as the space formed between the two connecting members 73.

Each of the connecting members 73 may have a first inclined portion 731, a second inclined portion 732, and an elongated portion 733 integrally extended between the first inclined portion 731 and the second inclined portion 732. The first inclined portions 731 of the connecting members 73 may be connected to the lifting member 72, while the second inclined portions 732 of the connecting members 73 may be connected to the depression member 71. For each of the connecting members 73, the first inclined portion 731 and the second inclined portion 732 may be upwardly and inclinedly extended from two ends of the corresponding elongated portion 733.

Figure 5:
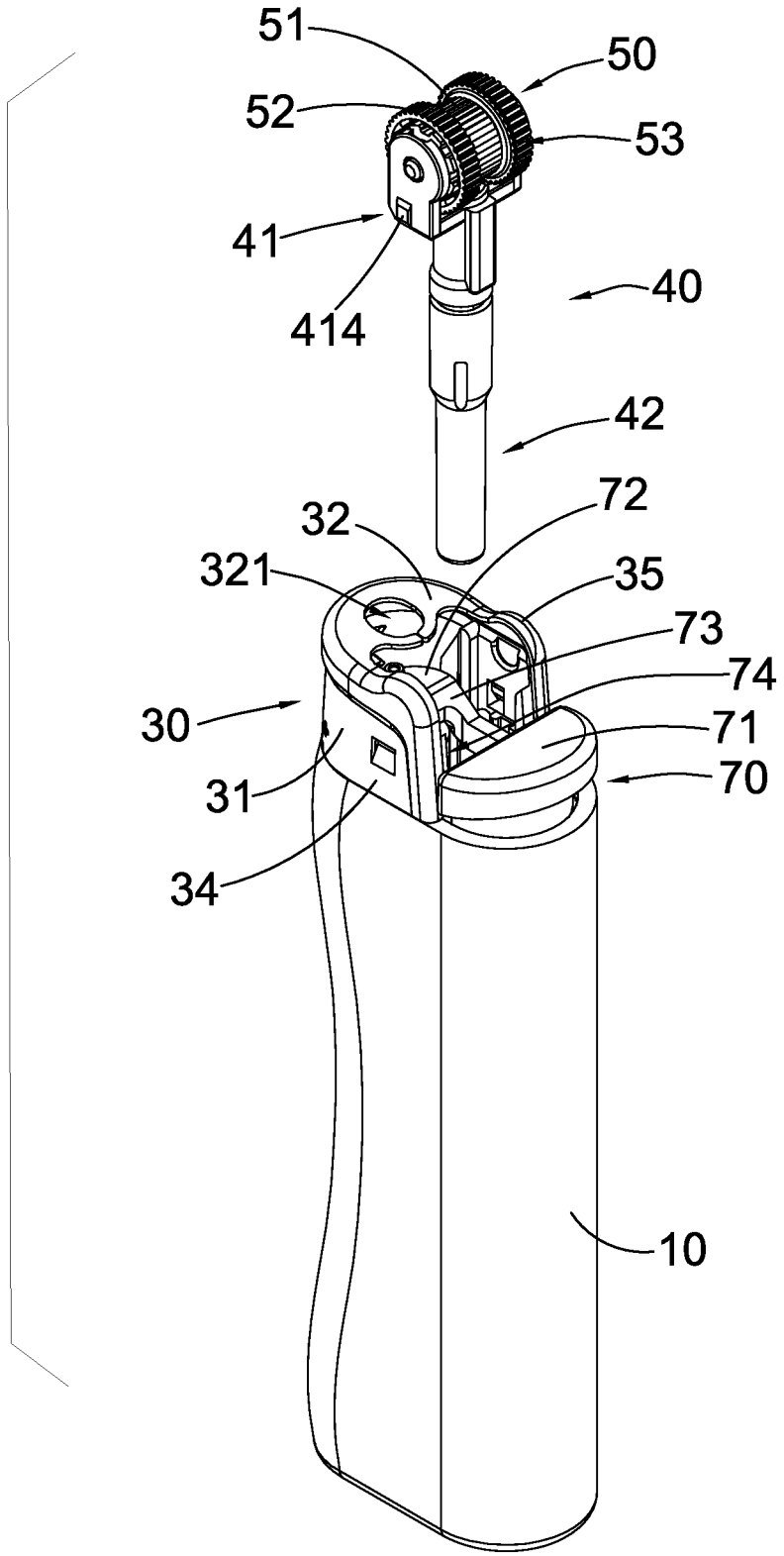
FIG. 5 is an exploded perspective view of the lighter according to the preferred embodiment of the present invention.
Figure 8:
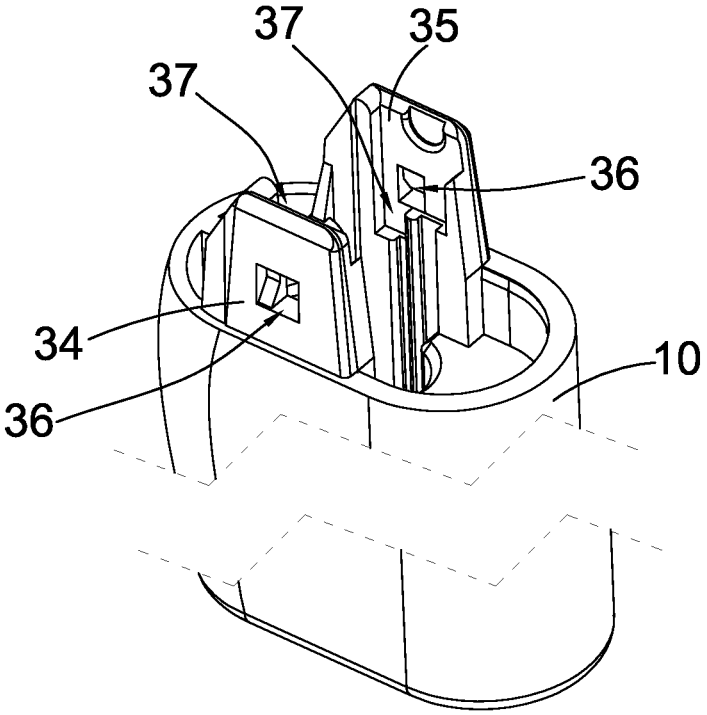
FIG. 8 is a partial perspective view of a supporting frame of the lighter according to the preferred embodiment of the present invention.

As shown in FIG. 3, FIG. 5 and FIG. 8 of the drawings, the flint mounting frame 40 may penetrate through the passage slot 74 so that the upper operative frame 41 may be mounted on the first securing frame 34 and the second securing frame 35 through the engaging members 414. The lower mounting frame 42 may downwardly extend from the upper operative frame 41 through the passage slot 74.

The actuator 70 may further comprise a plurality of pivotal shafts 75 outwardly extended from the connecting members 73 to pivotally connect to the first securing frame 34 and the second securing frame 35 respectively. Accordingly, each of the first securing frame 34 and the second securing frame 35 may have a positioning slot 37 positioned to correspond to that of the pivotal shafts 75. The pivotal shafts 75 may be arranged to pivotally connect to the positioning slots 37 so as to pivotally connect the actuator 70 to the first securing frame 34 and the second securing frame 35. In this preferred embodiment of the present invention, the pivotal shafts 75 may outwardly extend from the first inclined portions 731 of the connecting members 73 respectively.

The lifting member 72 may have a lifting slot 721 engaging with the gas-releasing nozzle 20. When the depression member 71 is depressed, the lifting member 72 may be pivotally move upwardly by lever action of the connecting members 73 so as to lift up the gas-releasing nozzle 20 for releasing the fuel stored in the fuel storage cavity 11 in gaseous form.

As shown in FIG. 9A to FIG. 9E of the drawings, the operation of the present invention may be described as follows: when a user wishes to ignite the lighter, he may manually depress the depression member 71 of the actuator 70 so as to lift up the gas-releasing nozzle 20 for releasing fuel in gaseous form to the wheel cavity 413. At the same time, the user may rotate the spark wheel 50 so that the teeth 53 of the main ignition wheel 51 may hit the upper end 61 of the flint member 60 and generate a spark in the wheel cavity 413. The results of these actions generate a flame at the flame releasing slot 321 formed on the top wall 32 of the supporting member 30.

Figure 9A:
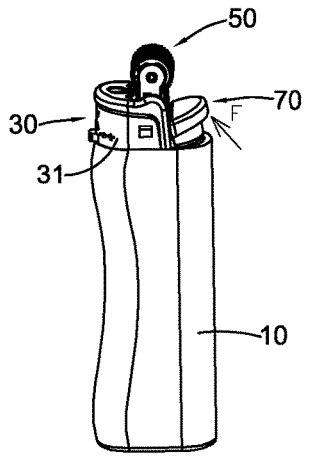
FIG. 9A to FIG. 9E are schematic diagram illustrating replacement of flint member of the lighter according to the preferred embodiment of the present invention.
Figure 9B:
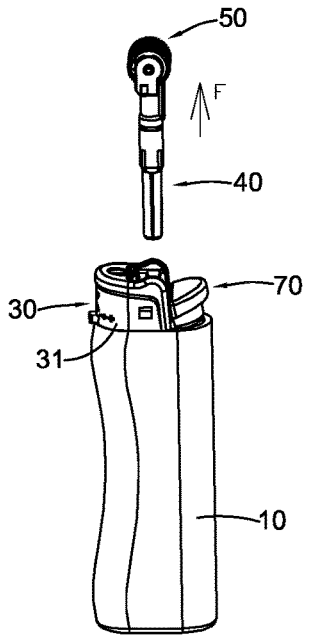
Figure 9C:
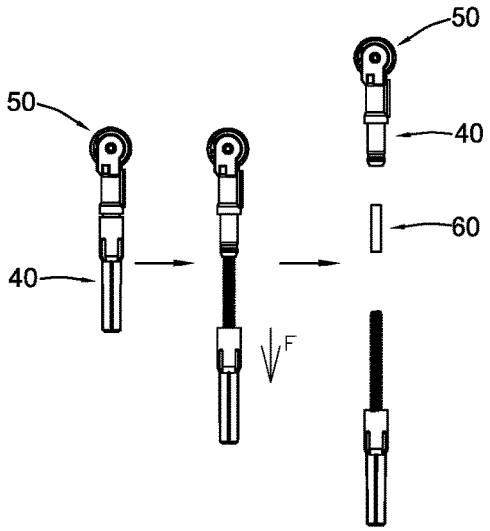
Figure 9D:
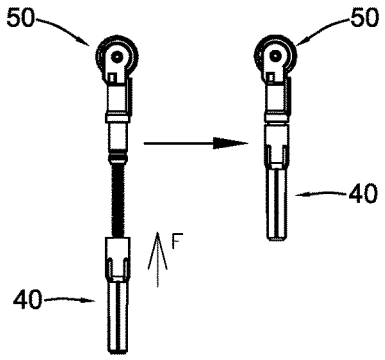
Figure 9E:
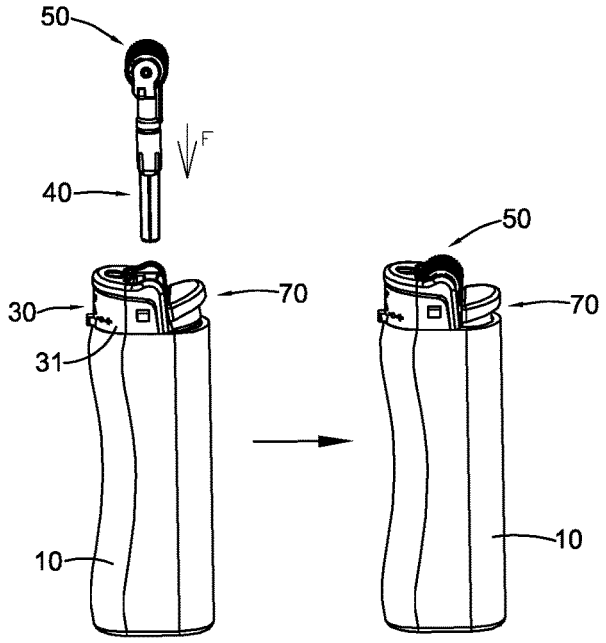

When the user wishes to replace the flint member 60, the user may need to pivotally move the depression member 71 of the actuator 70 in upward direction (see FIG. 9A). In doing so, the elongated portions 733 of the connecting members 73 may bias against the upper operative frame 41 so as to disengage the engaging members 414 from the engaging slots 36. This action may cause the upper operative frame 41 to disengage from the supporting frame 30. A user may then manually take out the entire flint mounting frame 40 from the fuel casing 10 (see FIG. 9B). The user may then detach the lower mounting frame 42 from the upper extension member 415 of the upper operative frame 41 and replace the flint member 60 received in the upper cavity 4141 (see FIG. 9C). After that, the user may re-attach the lower mounting frame 42 back to the upper operative frame 41 and re-attach the flint mounting frame 40 back to the supporting frame 30 by inserting the lower mounting frame 42 into the accommodating slot 12 and engaging the engaging members 414 to the engaging slots 36 (see FIG. 9D and FIG. 9E). After that, the depression member 71 may be pushed to restore to its original position.

From the forgoing descriptions, one skilled in the art may appreciate that the present invention may allow a user to conveniently replace the flint member 60 from the lighter. Thus, when the flint member 60 is dissipated due to prolonged usage, the user can only replace the flint member 60 without replacing the entire lighter.

Embodiments of the present disclosure, while illustrated and described in terms of a preferred embodiment and several alternatives, is not limited to the particular description contained in this specification. Additional alternative or equivalent components could also be used to practice embodiments of the present disclosure.

What is claimed is:

1. A lighter, comprising:

a fuel casing having a fuel storage cavity, and an accommodating slot formed in said fuel storage cavity;

a gas-releasing nozzle movably provided on said fuel casing;

a supporting frame provided on said fuel casing; and a flint mounting frame having an upper operative frame detachably mounted on said supporting frame, and a lower mounting frame detachably attached on said upper operative frame and at least partially extended in said accommodating slot;

a spark wheel rotatably supported on said upper operative frame of said flint mounting frame;

a flint member detachably mounted in said lower mounting frame of said flint mounting frame and extended toward said upper operative frame to communicate with said spark wheel, in such a manner that when said spark wheel is rotated, a spark is generated at said flint member, wherein when said flint mounting frame is detached from said supporting frame and said fuel casing, said flint member is capable of being detached from said lower mounting frame for replacement;

an actuator operatively mounted on said supporting frame and connected to said gas-releasing nozzle, in such a manner that when said actuator is depressed, said gas-releasing nozzle is lifted up for releasing fuel stored in said fuel storage cavity, said actuator comprising a depression member movably provided on top of said fuel casing, a lifting member connected to said gas-releasing nozzle, and a plurality of connecting members extended between said depression member and said lifting member, said actuator further having a passage slot defined as a space formed between said two connecting members; and a first securing frame and a second securing frame extended from said fuel casing and positioned adjacent to said supporting frame, wherein said first securing frame and said second securing frame are positioned to face each other, at least one of said first securing frame and said second securing frame having at least one engaging slot, wherein at least one of said connecting members has a first inclined portion, a second inclined portion, and an elongated portion integrally extended between said first inclined portion and said second inclined portion, said first inclined portions being connected to said lifting member, while said second inclined portions being connected to said depression member, said first inclined portion and said second inclined portion upwardly and inclinedly extending from two ends of said elongated portion.

2. A lighter, comprising:

a fuel casing having a fuel storage cavity, and an accommodating slot formed in said fuel storage cavity;

a gas-releasing nozzle movably provided on said fuel casing;

a supporting frame provided on said fuel casing; and a flint mounting frame having an upper operative frame detachably mounted on said supporting frame, and a lower mounting frame detachably attached on said upper operative frame and at least partially extended in said accommodating slot, said upper operative frame comprising an upper extension member having an upper cavity, said lower mounting frame being configured to have a hollow structure and having a lower cavity, said lower mounting frame being detachably attached to said upper extension member so that said lower cavity is arranged to communicate with said upper cavity when said lower mounting frame is detachably attached to said upper extension member, said flint mounting frame further comprising a resilient element;

a spark wheel which is rotatably supported on said upper operative frame of said flint mounting frame, and comprises a main ignition wheel and a plurality of retention wheels coaxially provided at two sides of said main ignition wheel, a diameter of each of said retention wheels being greater than that of said main ignition wheel;

a flint member detachably mounted in said lower mounting frame of said flint mounting frame and extended toward said upper operative frame to communicate with said spark wheel, in such a manner that when said spark wheel is rotated, a spark is generated at said flint member, wherein when said flint mounting frame is detached from said supporting frame and said fuel casing, said flint member is capable of being detached from said lower mounting frame for replacement, said resilient element of said flint mounting being partially received in said lower cavity for biasing against said flint member; and an actuator operatively mounted on said supporting frame and connected to said gas-releasing nozzle, in such a manner that when said actuator is depressed, said gas-releasing nozzle is lifted up for releasing fuel stored in said fuel storage cavity, said actuator comprising a depression member movably provided on top of said fuel casing, a lifting member connected to said gas-releasing nozzle, and a plurality of connecting members extended between said depression member and said lifting member, said actuator further having a passage slot defined as a space formed between said two connecting members, wherein at least one of said connecting members has a first inclined portion, a second inclined portion, and an elongated portion integrally extended between said first inclined portion and said second inclined portion, said first inclined portions being connected to said lifting member, while said second inclined portions being connected to said depression member, said first inclined portion and said second inclined portion upwardly and inclinedly extending from two ends of said elongated portion.

3. A lighter, comprising:

a fuel casing having a fuel storage cavity, and an accommodating slot formed in said fuel storage cavity;

a gas-releasing nozzle movably provided on said fuel casing;

a supporting frame provided on said fuel casing; and a flint mounting frame having an upper operative frame detachably mounted on said supporting frame, and a lower mounting frame detachably attached on said upper operative frame and at least partially extended in said accommodating slot, said upper operative frame of said flint mounting member comprising a supporting base wall, two sidewalls upwardly extended from said supporting base wall to form a wheel cavity at a space surrounded by said supporting base wall and said two sidewalls, at least one engaging member outwardly protruded from at least one of said two sidewalls respectively, and an upper extension member downwardly extended from said base wall to detachably connect to said lower mounting frame, said upper extension member being configured to be a hollow structure and having an upper cavity for at least partially accommodating said flint member therein, said base wall further having a through hole for communicating said wheel cavity with said upper cavity of said upper extension member, said lower mounting frame being configured to have a hollow structure and having a lower cavity, said flint mounting frame further comprising a resilient element partially received in said lower cavity, said lower mounting frame being detachably attached to said upper extension member so that said lower cavity is arranged to communicate with said upper cavity when said lower mounting frame is detachably attached to said upper extension member;

a spark wheel rotatably supported in said wheel cavity of said upper operative frame of said flint mounting frame, said spark wheel comprising a main ignition wheel and a plurality of retention wheels coaxially provided at two sides of said main ignition wheel, a diameter of each of said retention wheels being greater than that of said main ignition wheel;

a flint member detachably mounted in said lower mounting frame of said flint mounting frame and extended toward said upper operative frame to communicate with said spark wheel, in such a manner that when said spark wheel is rotated, a spark is generated at said flint member, wherein when said flint mounting frame is detached from said supporting frame and said fuel casing, said flint member is capable of being detached from said lower mounting frame for replacement, said resilient element of said flint mounting being partially received in said lower cavity for biasing against said flint member;

an actuator operatively mounted on said supporting frame and connected to said gas-releasing nozzle, in such a manner that when said actuator is depressed, said gas-releasing nozzle is lifted up for releasing fuel stored in said fuel storage cavity, said actuator comprising a depression member movably provided on top of said fuel casing, a lifting member connected to said gas-releasing nozzle, and a plurality of connecting members extended between said depression member and said lifting member, said actuator further having a passage slot defined as a space formed between said two connecting members; and a first securing frame and a second securing frame extended from said fuel casing and positioned adjacent to said supporting frame, wherein said first securing frame and said second securing frame are positioned to face each other, at least one of said first securing frame and said second securing frame having at least one engaging slot, said engaging member being positioned corresponding to said engaging slot, and arranged to detachably engage with said engaging slot when said upper operative frame is detachably accommodated in said receiving cavity, wherein at least one of said connecting members has a first inclined portion, a second inclined portion, and an elongated portion integrally extended between said first inclined portion and said second inclined portion, said first inclined portions being connected to said lifting member, while said second inclined portions being connected to said depression member, said first inclined portion and said second inclined portion upwardly and inclinedly extending from two ends of said elongated portion.

4. The lighter, as recited in claim 1, wherein said actuator further comprises a plurality of pivotal shafts outwardly extended from said connecting member to pivotally connect to said first securing frame and said second securing frame respectively, each of said first securing frame and said second securing frame having a positioning slot positioned to correspond to that of said corresponding pivotal shaft.

5. The lighter, as recited in claim 2, wherein said actuator further comprises a plurality of pivotal shafts outwardly extended from said connecting member to pivotally connect to said first securing frame and said second securing frame respectively, each of said first securing frame and said second securing frame having a positioning slot positioned to correspond to that of said corresponding pivotal shaft.

6. The lighter, as recited in claim 3, wherein said actuator further comprises a plurality of pivotal shafts outwardly extended from said connecting member to pivotally connect to said first securing frame and said second securing frame respectively, each of said first securing frame and said second securing frame having a positioning slot positioned to correspond to that of said corresponding pivotal shaft.

7. The lighter, as recited in claim 6, wherein said supporting frame comprises a side boundary wall, a top wall, and a receiving cavity formed in a space surrounded by said side boundary wall and said top wall, said top wall having a flame releasing slot for allowing flame to pass through, said gas-releasing nozzle being positioned corresponding to said flame releasing slot.

* * * * *